US005366012A

United States Patent [19]

Lohbeck

[11] Patent Number: 5,366,012

[45] Date of Patent: Nov. 22, 1994

[54] METHOD OF COMPLETING AN UNCASED SECTION OF A BOREHOLE

[75] Inventor: Wilhelmus C. M. Lohbeck, Rijswijk, Netherlands

[73] Assignee: Shell Oil Company, Houston, Tex.

[21] Appl. No.: 72,290

[22] Filed: Jun. 7, 1993

[30] Foreign Application Priority Data

Jun. 9, 1992 [EP] European Pat. Off. ..... 92201669.6

[51] Int. Cl.[5] ..... E21B 23/00; E21B 29/08; E21B 43/10

[52] U.S. Cl. ..... 166/277; 166/227; 166/207

[58] Field of Search ..... 166/277, 381, 74, 227, 166/236, 207, 217, 228, 297, 298

[56] References Cited

U.S. PATENT DOCUMENTS

| | | | |
|---|---|---|---|
| 1,135,809 | 4/1915 | Jones | 166/195 |
| 1,620,412 | 3/1927 | Tweeddale | 166/236 X |
| 3,191,680 | 6/1965 | Vincent | 166/387 |
| 3,353,599 | 11/1967 | Swift | 166/278 |
| 3,785,193 | 1/1974 | Kinley et al. | 166/277 X |
| 4,977,958 | 12/1990 | Miller | 166/205 |

OTHER PUBLICATIONS

U.S. patent application Ser. No. 072,288 filed Jun. 7, 1993, entitled "Method of Creating a Wellbore in an Underground Formation", by Robert N. Worrall et al–related application.

*Primary Examiner*—Stephen J. Novosad

[57] ABSTRACT

Method of completing an uncased section (10) of a borehole (1) in an underground formation (2) comprising the steps of:

(a) placing at a predetermined position in the borehole (1) a slotted liner (11) provided with overlapping longitudinal slots (12);

(b) fixing the upper end of the slotted liner (11); and (c) moving upwardly through the slotted liner (11) an upwardly tapering expansion mandrel (15) having a largest diameter which is larger than the inner diameter of the slotted liner (11).

9 Claims, 2 Drawing Sheets

FIG. 3
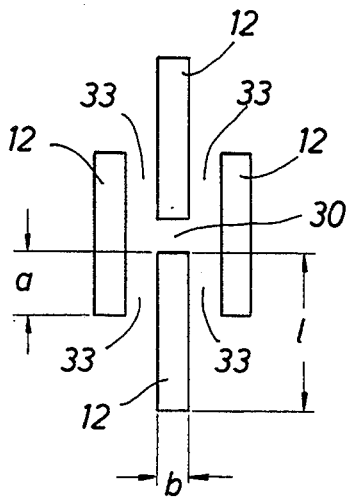
FIG. 4
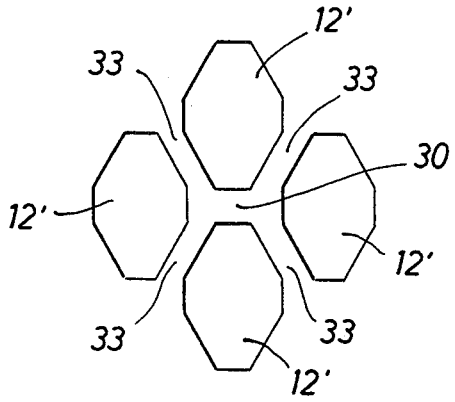
FIG. 5
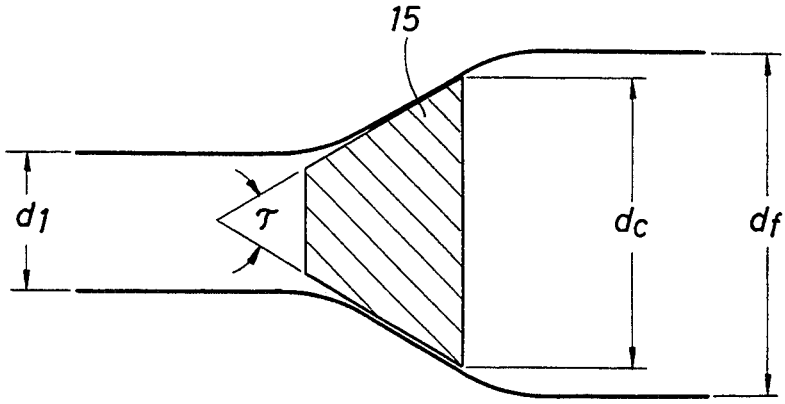
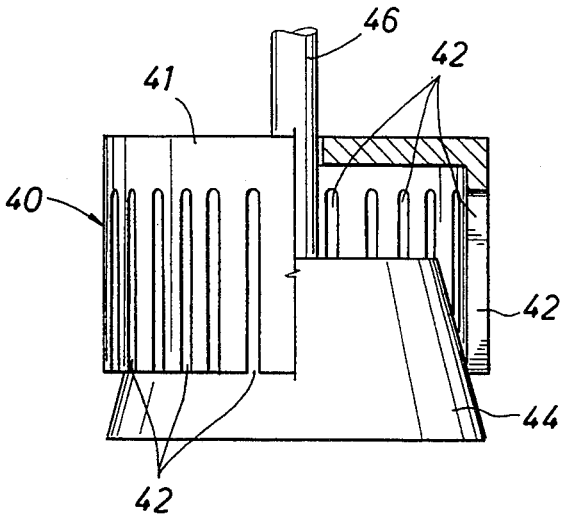
FIG. 6

METHOD OF COMPLETING AN UNCASED SECTION OF A BOREHOLE

FIELD OF THE INVENTION

The present invention relates to completing an uncased section of a borehole in an underground formation.

BACKGROUND OF THE INVENTION

An example of a borehole for which the present invention would be useful is a borehole drilled to produce hydrocarbons from a hydrocarbon-containing formation. To prevent collapse of the wall of the borehole, the borehole is cased by means of a casing arranged in the borehole. The casing is fixed in the borehole by a cement layer between the outer wall of the casing and the inner wall of the borehole.

The borehole is not cased where it traverses the hydrocarbon-containing formation to allow substantially unrestricted influx of fluids from the hydrocarbon-containing formation into the borehole. When the hydrocarbon-containing formation is so weak that it will collapse, the uncased borehole section is completed with a liner. The liner is provided with slots to allow fluid influx into the borehole.

A known method of completing an uncased section of a borehole in an underground formation comprises the steps of placing a slotted liner in the borehole at the location of the hydrocarbon-containing formation and fixing the liner. Fixing the liner is usually accomplished by securing the upper end of the liner to the lower end of the casing arranged in the borehole.

Because the inner diameter of the cased section is less than the diameter of the borehole, and the slotted liner has to be lowered through the cased section of the borehole, the diameter of the slotted liner is smaller than the diameter of the borehole. Thus there is an annular space between the liner and the wall of the borehole. With time the formation will collapse and settle against the outer wall of the liner so that the annular space gets filled with particulates. When hydrocarbons are produced, the fluid will flow through the formation, through the filled annular space and through the slots in the liner into the cased borehole. The circumference through which fluids flow into the cased borehole is thus reduced from the circumference of the borehole to the circumference of the outer wall of the liner.

Reference is made to U.S. patent specification No. 1,135,809 disclosing completing an uncased section of a borehole with a slotted liner having overlapping slots. This publication, however, does not disclose expanding the slotted liner.

It is therefore an object of the present invention to provide a method of completing an uncased section of a borehole, wherein optimal use is made of the circumference of the borehole to reduce resistance to fluid flow as much as possible.

SUMMARY OF THE INVENTION

To this end a method of completing an uncased section of a borehole in an underground formation according to the invention comprises the steps of:

(a) placing at a predetermined position in the borehole a slotted liner provided with overlapping longitudinal slots;

(b) fixing the slotted liner; and (c) moving through the slotted liner an expansion mandrel which is tapered in the direction in which the mandrel is moved through the slotted liner, which mandrel has a largest diameter which is larger than the inner diameter of the slotted liner.

It will be appreciated that in step (c) the diameter of the slotted liner is enlarged. Enlarging the diameter can be done by pushing an expansion mandrel downwardly through the slotted liner, wherein the expansion mandrel is tapered downwardly; or, more suitably, the diameter of the slotted liner is enlarged by pulling upwardly through the slotted liner an expansion mandrel which is tapered upwardly.

It was surprisingly found that a slotted liner expanded with the expansion mandrel has a permanent final diameter that is larger than the largest diameter of the expansion mandrel when the mandrel has a bevel angle of greater than about 13 degrees. The difference between the permanent final diameter and the largest diameter of the expansion mandrel is referred to as permanent surplus expansion. This permanent surplus expansion was found for a cone angle in excess of about 13°. Suitably the cone angle is in the range of from 30° to 90°.

As the slotted liner will act as a filter a slotted liner is sometimes referred to as a strainer.

BRIEF DESCRIPTION OF THE DRAWINGS

FIG. 3 shows detail III of FIG. 1.

FIG. 4 shows detail IV of FIG. 2.

FIG. 5 shows schematically a cross-section of the slotted liner to indicate relevant dimensions.

FIG. 6 shows schematically an alternative embodiment of an expansion mandrel.

DETAILED DESCRIPTION OF THE INVENTION

Figure 1:
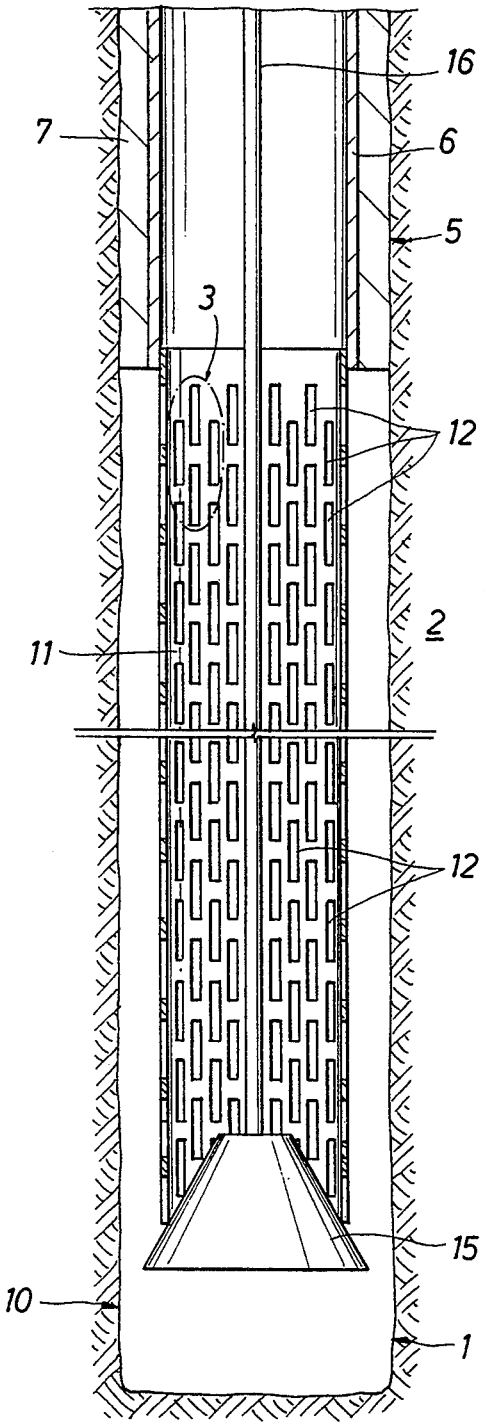
FIG. 1 shows schematically a longitudinal view of a cased borehole having an uncased section that has to be completed.

Reference is now made to FIG. 1 showing the lower part of a borehole 1 drilled in an underground formation 2. The borehole 1 has a cased section 5, wherein the borehole 1 is lined with a casing 6 secured to the wall of the borehole 1 by means of a layer of cement 7, and an uncased section 10.

In the uncased section 10 of a borehole 1 a slotted liner 11 provided with overlapping longitudinal slots 12 has been lowered to a predetermined position, in this case the end of the casing 6. For clarity, not all slots have been designated with a reference numeral.

The upper end of the slotted liner 11 has been fixed to the lower end of the casing 6 by means of a connecting means (not shown) provided with suitable seals.

Having fixed the upper end of the slotted liner 11 the slotted liner 11 is expanded using an expansion mandrel 15. The slotted liner 11 has been lowered at the lower end of string 16 resting on the expansion mandrel 15. To expand the slotted liner 11 the expansion mandrel 15 is moved upwardly through the slotted liner 11 by pulling on string 16. The expansion mandrel 15 is tapered in the direction in which the mandrel 15 is moved through the slotted liner 11, in this case the expansion mandrel 15 is an upwardly tapering expansion mandrel. The expansion mandrel 15 has a largest diameter which is larger than the inner diameter of the slotted liner 11.

Figure 2:
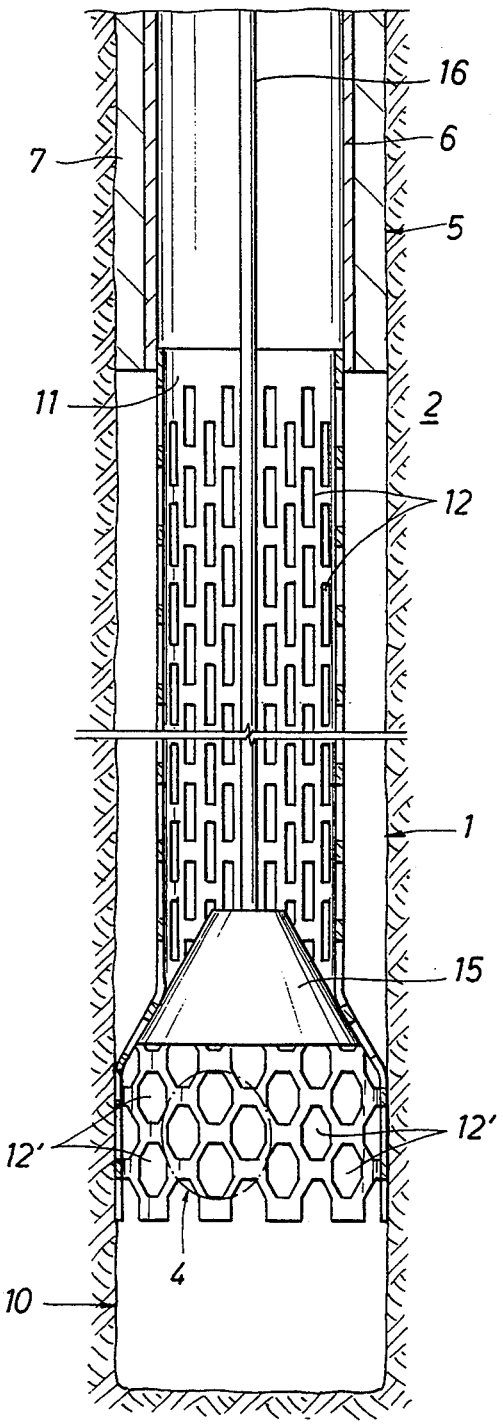
FIG. 2 shows part of FIG. 1, wherein the part of the slotted liner has been expanded.

FIG. 2 shows the slotted finer 11 in partly expanded form, wherein the lower part of the slotted liner has been expanded. The same features as shown in FIG. 1 have the same reference numerals. The deformed slots have been designated with reference numeral 12'

FIG. 3 shows the arrangement of the undeformed slots 12 in the slotted liner, '1' is the length of the slot, 'a' is the length of the overlap, and 'b' is the width of the slot. FIG. 4 shows the deformed slots 12'.

Comparing FIG. 3 with FIG. 4 it can be seen that the wall pieces 30 of the slotted liner wherein the slots do not overlap have deformed in circumferential direction. In the adjacent sections wherein the slots do overlap the wall pieces 33 between adjacent slots have rotated. Additionally, the wall pieces 33 have bent out of the cylindrical surface of the undeformed liner (the out of surface bending is not shown in FIG. 4). The combination of rotation and bending controls the expansion, and the circumferential deformation preserves the expansion of the slotted liner.

It was surprisingly found that for a cone angle larger than 13° the permanent final diameter of the slotted liner is larger than the diameter of the expansion mandrel.

Reference is now made to FIG. 5, wherein '$d_l$' is the original outer diameter of the slotted liner (before expansion), '$d_c$' is the largest diameter of the expansion mandrel, $\tau$ is the cone angle, and $d_f$ is the permanent final outer diameter of the expanded slotted liner.

With this configuration several tests have been carried out and the results are tabulated in the Table, wherein 't' is the wall thickness of the slotted liner and 'n' is the number of slots in circumferential direction.

The results clearly show the permanent surplus expansion for a cone angle larger than 13°. For a cone angle larger than 30° the permanent surplus expansion is very pronounced.

TABLE

Summary of Test Results.

| dl (mm) | t (mm) | n | l | b (mm) | a/l (mm) | $\tau$ (°) | $d_c$ (mm) | $d_f$ (mm) |
|---|---|---|---|---|---|---|---|---|
| 101.60 | 6 | 25 | 50 | 1.0 | 0.25 | 40 | 161.04 | 166.62[1] |
| 88.90 | 7 | 24 | 50 | 0.7 | 0.25 | 40 | 133.35 | 136.91[1] |
| 44.45 | 2.8 | 16 | 40 | 1.0 | 0.10 | 65 | 73.79 | 80.01[2] |
| 38.10 | 2.8 | 16 | 30 | 1.0 | 0.33 | 13 | 56.39 | 55.63[2] |
| 38.10 | 2.8 | 16 | 30 | 1.0 | 0.33 | 30 | 56.39 | 59.06[2] |
| 38.10 | 2.8 | 16 | 30 | 1.0 | 0.33 | 30 | 56.39 | 57.53[2] |
| 38.10 | 2.8 | 16 | 30 | 1.0 | 0.33 | 40 | 56.39 | 60.20[2] |
| 31.75 | 2 | 16 | 25 | 1.0 | 0.17 | 40 | 55.56 | 61.60[2] |
| 31.75 | 2 | 8 | 30 | 1.0 | 0.33 | 45 | 55.56 | 56.52[2] |
| 25.40 | 1.8 | 12 | 20 | 1.0 | 0.25 | 65 | 39.12 | 41.15[2] |
| 25.40 | 1.8 | 12 | 30 | 1.0 | 0.25 | 80 | 50.67 | 55.88[3] |
| 25.40 | 1.8 | 12 | 30 | 1.0 | 0.25 | 40 | 49.28 | 50.29[3] |
| 25.40 | 1.8 | 12 | 30 | 1.0 | 0.25 | 65 | 39.12 | 40.64[3] |

[1]Tube is made of J55 steel having a minimum yield strength of 380 MPa (55 000 psi) and a minimum tensile strength of 520 MPa (75 000 psi).
[2]Tube is made of coil tubing steel having a minimum yield strength of 480 MPa (70 000 psi) and a minimum tensile strength of 550 MPa (80 000 psi).
[3]Tube is made of AISI 316L steel having a minimum yield strength of 190 MPa (28 000 psi) and a minimum tensile strength of 490 MPa (71 000 psi).

Reference is now made to FIG. 6, showing an alternative expansion mandrel 40 consisting of a cylindrical housing 41 having axial fingers 42 which can deflect outwardly and a cone 44 arranged with axial play in the cylindrical housing 41 to deflect the fingers 42 outwardly. To the cone 44 is connected a string 46 for moving the expansion mandrel 40 through the slotted liner (not shown).

In an alternative embodiment of the invention, a system of two or more slotted liners one arranged in the other is placed at a predetermined position in the borehole. Suitably, a pair of slotted liners is employed. Each slotted liner is provided with overlapping slots and the slotted liners are arranged one in the other, wherein the relative position of the liners can be so selected that after expansion the slots are in radial direction either in line or not in line. When after expansion the slots are not in line in radial direction, fluids passing through the system have to traverse a zig-zag path; therefore this embodiment is suitable for preventing sand from entering into the borehole.

Another way of preventing sand from entering into the borehole is providing the outer surface of the slotted liner with a wrapping. Suitably the wrapping is a membrane or a screen having a fine mesh or a screen of sintered material or of sintered metal. The wrapping can as well be applied on the outer surface of the outermost slotted liner of the system of slotted liners.

In the above it was described that the slotted liner is lowered resting on the expansion mandrel; alternatively the liner is lowered first, is fixed and the expansion mandrel in contracted form is lowered through the slotted liner. After which the mandrel is expanded and pulled upwardly to expand the slotted liner.

The method according to the invention can be applied in a vertical borehole, in a deviated borehole or in a borehole having a horizontal end section.

A borehole can be drilled to allow production of fluids from an underground formation through the borehole, or the borehole can be used to inject fluids into the underground formation. The method of the present invention can also be used to complete a section of such a latter borehole.

The geometries of the slotted liner and of the expansion mandrel can be so selected that the final diameter of the unconfined (freely) expanded slotted liner, $d_f$ in FIG. 5, is larger than the diameter of the borehole. In this case the expanded slotted liner is compressed against the wall of the borehole and this further increases the stability of the borehole.

The expansion mandrel as described with reference to the Figures has a conical shape, when the intersecting line of the outer surface and a plane through the longitudinal axis of the expansion mandrel is curved, the half cone angle is defined by the tangent of the inner wall of the slotted finer and the curved intersecting fine.

What is claimed is:

1. A method of completing an uncased section of a borehole in an underground formation comprising the steps of:

(a) placing at a predetermined position in the borehole a slotted liner provided with overlapping longitudinal slots;

(b) fixing the slotted liner; and (c) moving through the slotted liner an expansion mandrel which is tapered in the direction in which the mandrel is moved through the slotted liner, which mandrel has a largest diameter which is larger than the inner diameter of the slotted liner whereby the inner diameter of the slotted liner is increased to a diameter that is greater than the largest diameter of the mandrel and slots of the slotted liner are expanded.

2. The method according to claim 1, wherein the outer surface of the slotted liner is provided with a wrapping.

3. The method according to claim 1, wherein the expansion mandrel consists of a cylindrical housing having outwardly deflecting fingers and a cone arranged with axial play in the cylindrical housing to deflect the fingers outwardly.

4. The method of claim 1 wherein the taper of the tapered mandrel forms a cone angle of greater than about 13°.

5. The method of claim 4 wherein the taper of the tapered mandrel forms a cone angle of at least about 30°.

6. The method of claim 4 wherein the amount of overlap is less than about 25 percent of the length of the slots.

7. The method of claim 1 wherein the amount of overlap is less than about 25 percent of the length of the slots.

8. The method of claim 1 wherein the amount of overlap is less than about 17 percent of the length of the slots.

9. The method of claim 6 which the amount of overlap is less than about 17 percent of the length of the slots.

* * * * *